US006145230A

United States Patent [19]

Holmberg

[11] Patent Number: 6,145,230

[45] Date of Patent: Nov. 14, 2000

[54] REMOVABLE ADVERTISING DISPLAY FOR PICKUP TRUCKS

[76] Inventor: Larry Allan Holmberg, 3917 87$^{th}$ La., Blaine, Minn. 55014

[21] Appl. No.: 09/286,644

[22] Filed: Apr. 2, 1999

[51] Int. Cl.$^{7}$ ..... G09F 21/04

[52] U.S. Cl. ..... 40/591; 40/572; 296/21

[58] Field of Search ..... 40/564, 572, 590, 40/591; 296/21, 183

[56] References Cited

U.S. PATENT DOCUMENTS

| | | | |
|---|---|---|---|
| 1,481,703 | 1/1924 | Forbes . | |
| 1,597,112 | 8/1926 | Rymal . | |
| 1,597,262 | 8/1926 | Bloodgood . | |
| 1,973,276 | 9/1934 | Bard | 40/591 |
| 2,530,525 | 11/1950 | Howenstine . | |
| 3,242,329 | 3/1966 | Abrams . | |
| 3,305,961 | 2/1967 | Lanzon . | |
| 3,702,033 | 11/1972 | Coleman . | |
| 3,802,103 | 4/1974 | Neff . | |
| 4,052,806 | 10/1977 | George . | |
| 4,346,529 | 8/1982 | Keller . | |
| 4,475,299 | 10/1984 | Nelson | 40/591 |
| 4,688,343 | 8/1987 | Allan . | |
| 5,084,994 | 2/1992 | Elmer . | |
| 5,210,970 | 5/1993 | Elmer . | |
| 5,249,833 | 10/1993 | Kobayashi . | |
| 5,339,551 | 8/1994 | Elmer . | |
| 5,887,931 | 3/1999 | Bills et al. | 40/591 X |
| 5,918,924 | 7/1999 | Cowan | 40/591 X |

FOREIGN PATENT DOCUMENTS

| | | |
|---|---|---|
| PCT/SE85/00345 | 3/1986 | WIPO . |

*Primary Examiner*—Brian K. Green
*Attorney, Agent, or Firm*—Scott V. Lundberg

[57] ABSTRACT

A large advertising assembly that can be easily moved from one pickup truck to another. The assembly includes an advertising display and a bed frame member. The bed frame member fits snugly into the bed of a standard pickup truck and provides a platform on which the advertising display is removably mounted. The advertising display has an internal light source, removable translucent advertising panels and a portion that extends over the cab of the pickup truck to provide a large area for advertisement.

5 Claims, 6 Drawing Sheets

REMOVABLE ADVERTISING DISPLAY FOR PICKUP TRUCKS

CROSS-REFERENCE TO RELATED APPLICATIONS

Not applicable.

STATEMENT REGARDING FEDERALLY SPONSORED RESEARCH

Not applicable.

BACKGROUND OF INVENTION

1. Field of Invention

This invention relates to a design of a large mobile advertising display that is carried in the bed of a standard pickup truck. The display is designed to be quickly and easily moved from one pickup truck to another.

2. Description of Related Art

An advertising display for a pick-up truck or similar vehicle is disclosed in U.S. Pat. No. 4,346,529 (Keller). This patent discloses a display that is directly mounted to the rear truck deck of a pickup. The display has a transparent surface that slopes from the cab to the tailgate of the pickup. The patent also discloses a means to move a plurality of advertising messages within the display. The messages are only visible from the rear of the truck.

A vehicle supporting advertising arrangement is disclosed in International Application WO86/01925 (Turcea). This international application discloses an advertising display that is directly mounted to a flat bed truck or trailer without sidewalls. The display is described as having a house shaped body with sides walls. The side walls have an outer layer of transparent plastic, an inter layer of light diffusing material and a middle layer containing advertising.

Other advertising displays mounted on truck like vehicles are illustrated in U.S. Pat. No. 5,249,833 (Kobayashi), U.S. Pat. No. 1,597,262 (Bloodgood) and in U.S. Pat. No. 1,597,112 (Rymal). The patent issued to Kobayashi discloses a display that has three screens that rotate positions. The patent issued to Bloodgood discloses display modules that rotate. The patent issued to Rymal discloses movable display means for advertising and a stationary display means for advertising. In each of the three aforementioned patents the vehicle used is specifically designed for the purpose of displaying advertisements.

Examples of illuminated advertising displays that are capable of being attached to vehicles can be seen in the following patents: U.S. Pat. No. 5,339,551 (Elmer), U.S. Pat. No. 5,210,970 (Elmer), U.S. Pat. No. 5,084,994 (Elmer), U.S. Pat. No. 4,688,343 (Allan), U.S. Patent No. 4,052,806 (George), U.S. Pat. No. 3,802,103 (Neff), U.S. Pat. No. 3,305,961 (Lanzon), U.S. Pat. No. 1,481,703 (Forbes) and U.S. Pat. No. 3,242,329 (Abrams). The displays disclosed in these patents generally provide only a small area to advertise with or only a one directional view display area.

A portable display device is disclosed in U.S. Pat. No. 3,702,033 (Coleman). The patent issued to Coleman discloses an advertising sign that can be mounted to a trailer so it can be moved around. An advertising display unit having opposed display faces arranged in spaced parallelism is disclosed in U.S. Pat. No. 2,530,525 (Howenstine). This patent only relates to stationary signs.

3. Limitations of Related Art

The previous related art does not enable the design of a large mobile advertising display that can be easily moved from one pickup truck to another. The need for a simple and efficient way for advertisers to convey their mobile messages without expending great sums of money on special vehicles to haul the displays around has long been felt. My present invention satisfies those needs.

BRIEF SUMMARY OF INVENTION

The advertising display that I have invented overcomes the problems of the related art. I have designed an advertising display that can be quickly and easily moved from one pickup truck to another. The advertising display is removably connected to a bed frame member. The bed frame member fits snugly into the bed of a standard pickup truck. In addition, the advertising display member has an internal light source, removable translucent advertising panels and a portion that extends over the cab of the pickup truck.

BRIEF DESCRIPTION OF DRAWINGS

The foregoing and other features and advantages will be apparent to those skilled in the art from the specification and the following illustrations of the preferred embodiments in which like reference numerals indicate like parts throughout the several views. Referring to the drawings.

DETAILED DESCRIPTION

Figure 1:
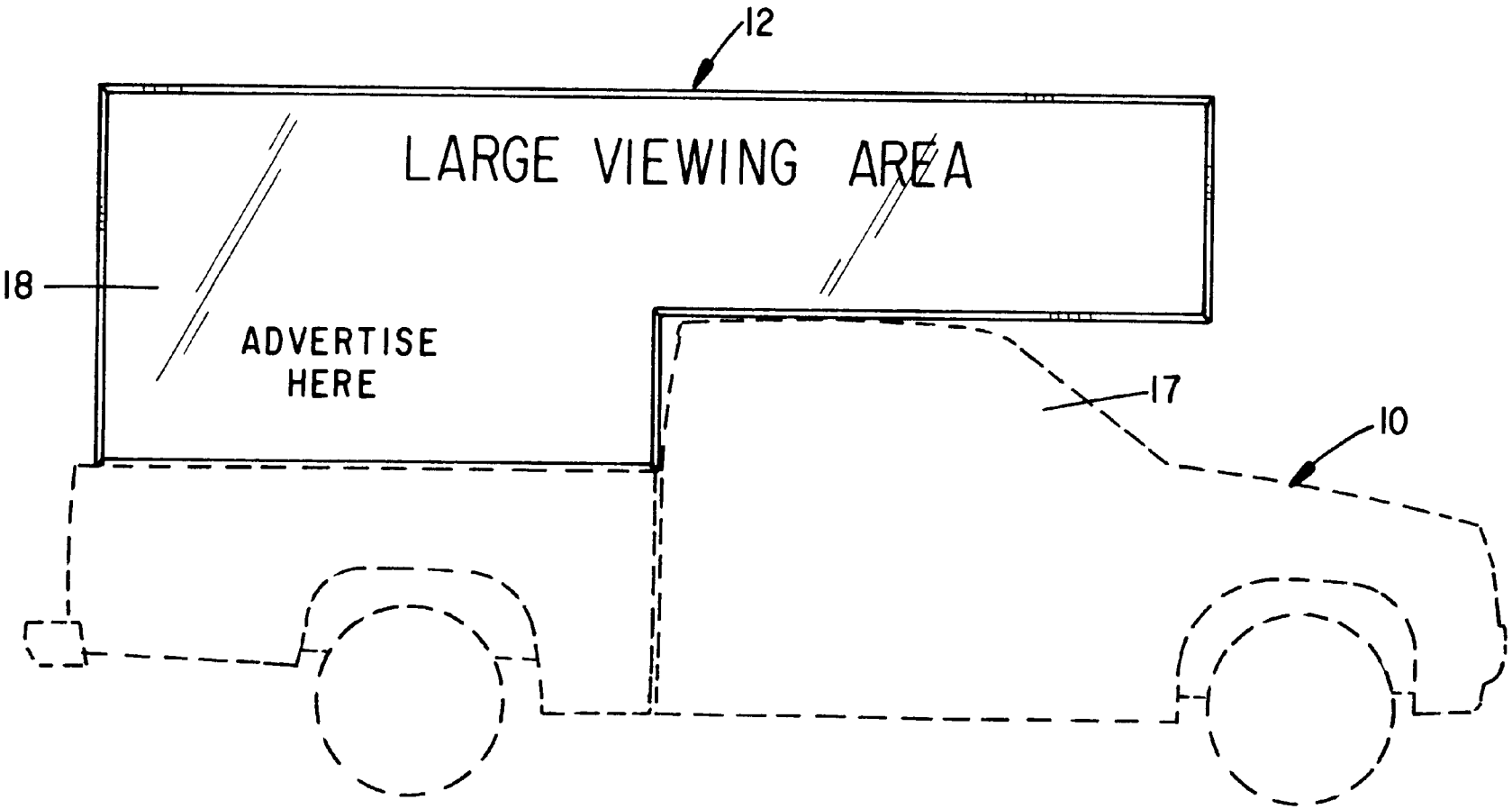
FIG. 1 is a perspective view of the preferred embodiment of the advertising display in the bed of a pickup truck.

My advertising display 12 invention in combination with a pickup truck 10 is illustrated in FIG. 1. As illustrated, my preferred embodiment has a portion of the advertising display 12 extending over the cab 17 of the pickup truck 10. This design provides a large area to display advertising messages.

Figure 2:
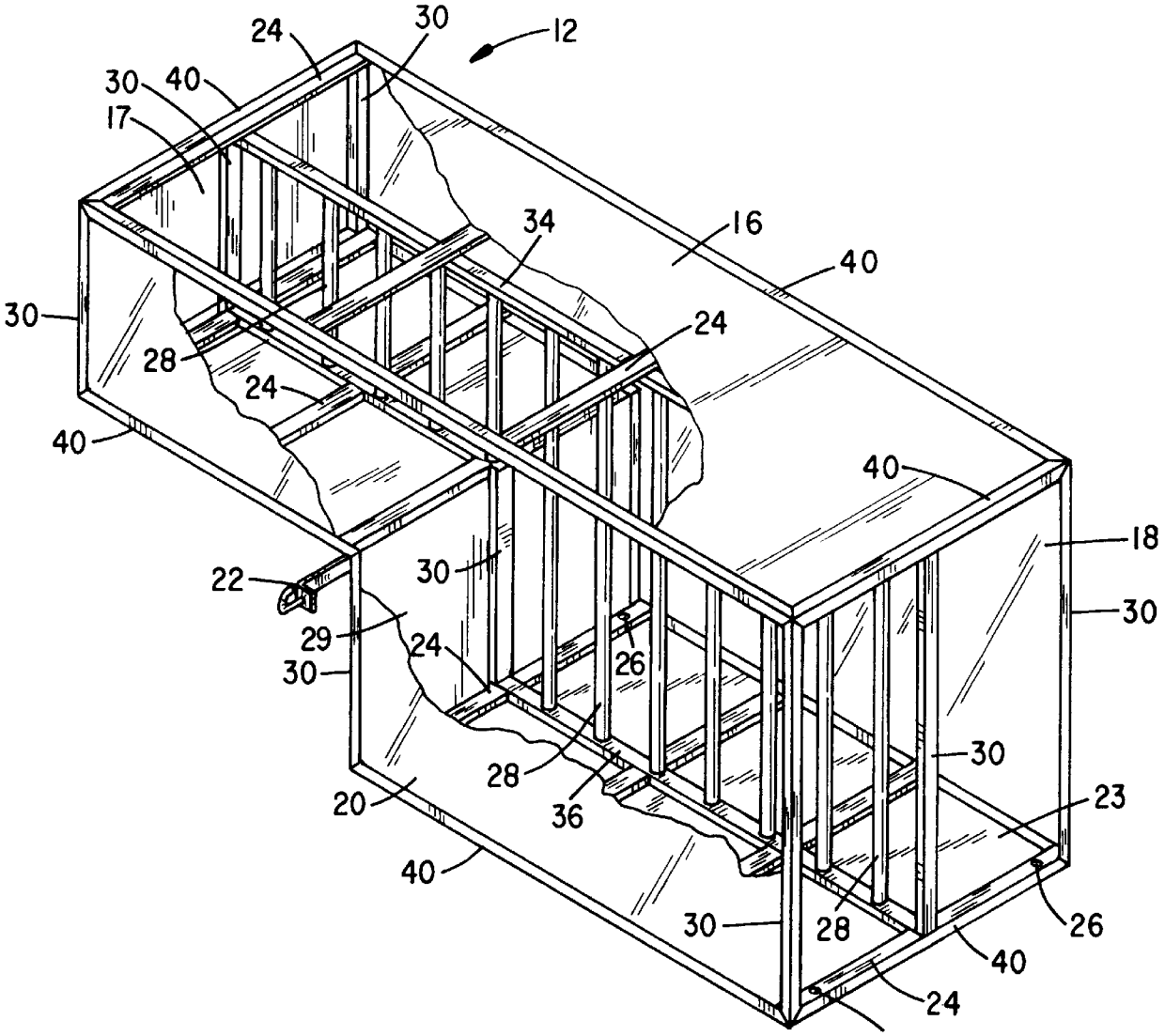
FIG. 2 is a cross-sectional view of the advertising display illustrating its construction.

The advertising display 12 itself is illustrated in FIG. 2. The advertising display 12 has an outer frame consisting of a plurality of horizontal support members 40 and plurality of vertical support members 30. In addition, a plurality of bar supports members 24 run along the bottom and the top of the display. The support members may be made of steel or some other rigid material with properties similar to steel. As illustrated, my preferred embodiment of the advertising display has a top panel 16, a bottom panel 23, a upper front panel 17, a lower front panel 29 and a back panel 21. These panels are held in place by the horizontal and vertical support members 40 and 30, and may be made of sheet metal or some other semi-rigid material with properties similar to sheet metal. They provide added support for the advertising display 12.

My invention has a plurality of light sources 28 encased inside the advertising display 12 for providing illumination.

The lights illustrated in FIG. 2 are drawn to represent flourescent lights but any applicable type of light source could be substituted. The light sources 28 may be powered by a battery or a generator common in the art of illuminated advertising displays. The light sources 28 are connected between a top light source holding member 34 and a bottom light source holding member 36. The the top light source holding member 34 and the bottom light source holding member 36 are solidly connected to, and held in place by, the plurality of bar support members 24.

Figure 3:
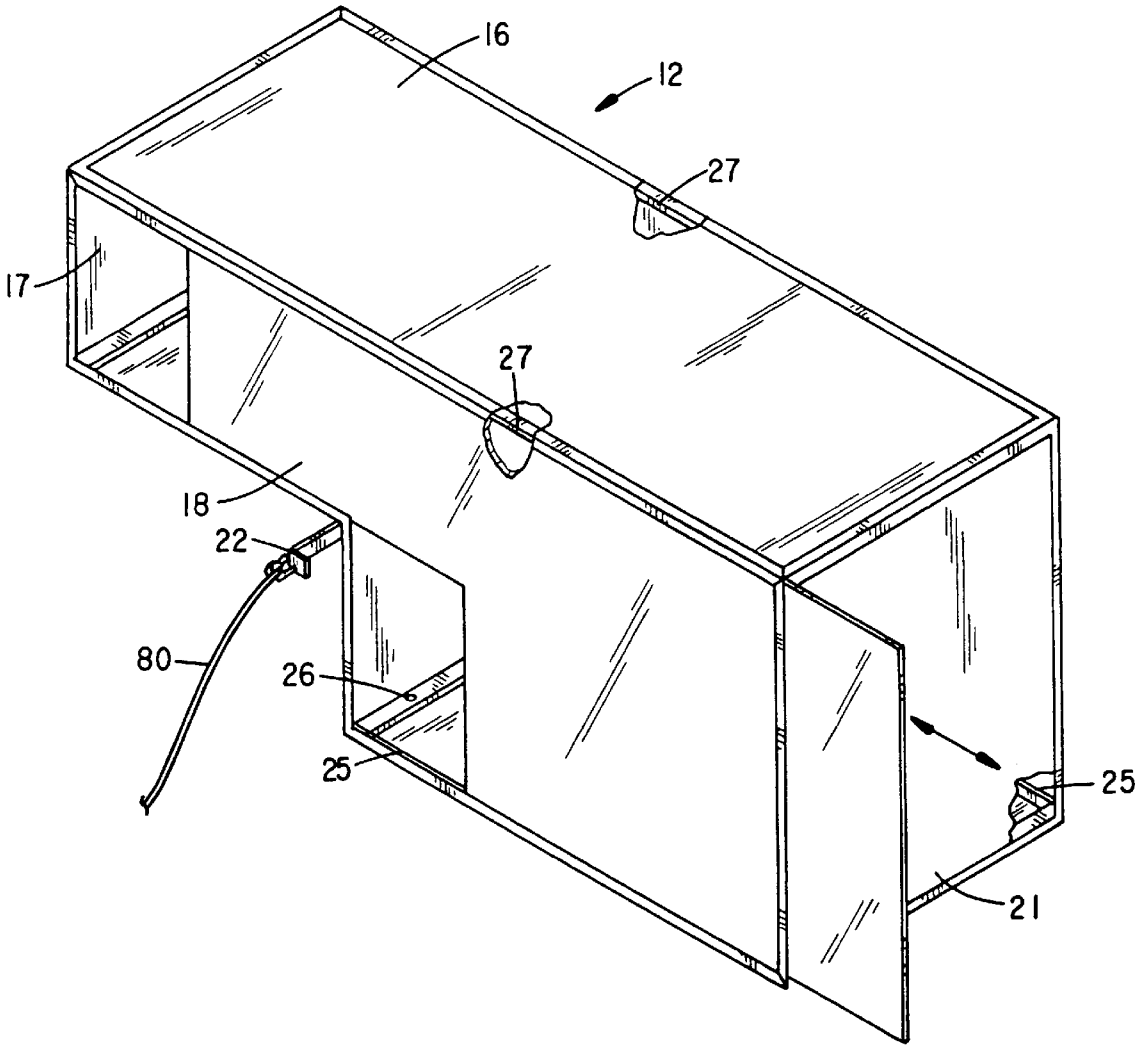
FIG. 3 is a side view of the advertising display illustrating the advertising panels.

Advertising messages may be placed on the right side advertising panel 18 and the left side advertising panel 20. The advertising panels 18 and 20 are translucent and may be made of a plexiglass or LEXAN or other similar material. My design also allows the advertising panels 18 and 20 to be easily removed and replaced. The advertising panels 18 and 20 are held in place by upper and lower tracks 25 and 27. The tracks 25 and 27 allow the panels 18 and 20 to slide back and forth. To remove the panels, the panels are simply slid back out of the advertising display 12 as illustrated in FIG. 3. This design not only allows the advertising message to be quickly and easily changed, it also provides easy access for service of the internal components of the display.

Figure 4:
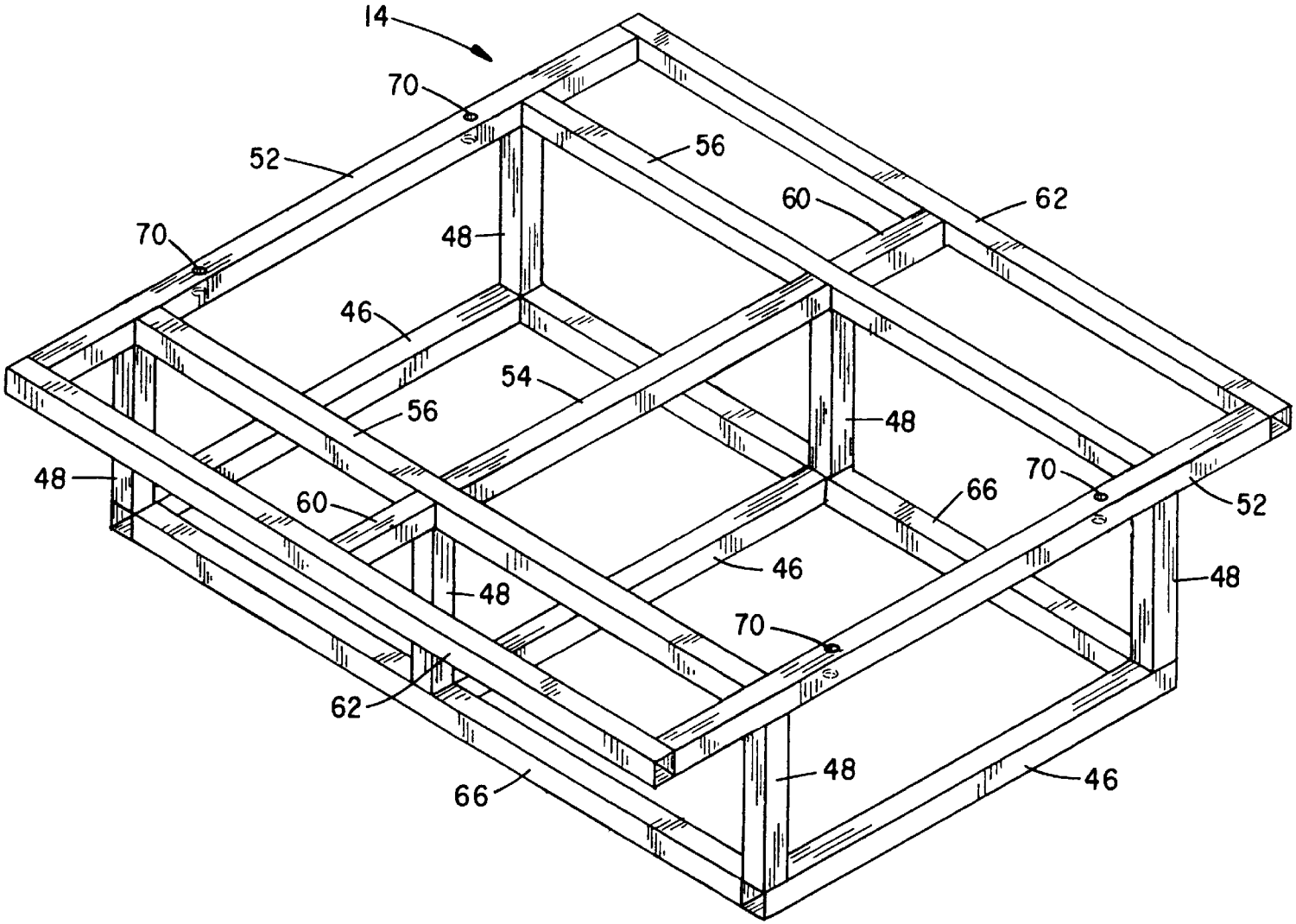
FIG. 4 is a perspective view of the first embodiment of the bed frame member.

My first embodiment of a bed frame member 14 is illustrated in FIG. 4. The bottom of the bed frame member 14 has a plurality of lower horizontal frame members 46. In this embodiment the length of the lower horizontal frame members 46 are all slightly shorter than the distance between the wheel wells 15 of the bed 11 of the pickup truck 10. In addition, the bottom of the bed frame member 14 has a pair of bottom side frame members 66. The bed frame member 14 also has a plurality of vertical frame members 48 of a given height. The top of the bed frame member 14 has horizontal end members 52, a middle horizontal frame member 54, a pair of inner horizontal frame members 56, a pair of top extending frame members 60 and a pair of outer horizontal frame members 62. All parts of the bed frame member 14 are solidly connected to each other. The width of the top of the bed frame member 14 is slightly less than the distance between the sidewalls 13 of the bed 11 of the pickup truck 10. The length of the bed frame member 14 is slightly less than the length of the bed 11 of the pickup truck 10. In addition, the total height of the bed frame member 14 is substantially equal to the height of the sidewalls 13 of the bed 11 of the pickup truck 10.

Figure 6:
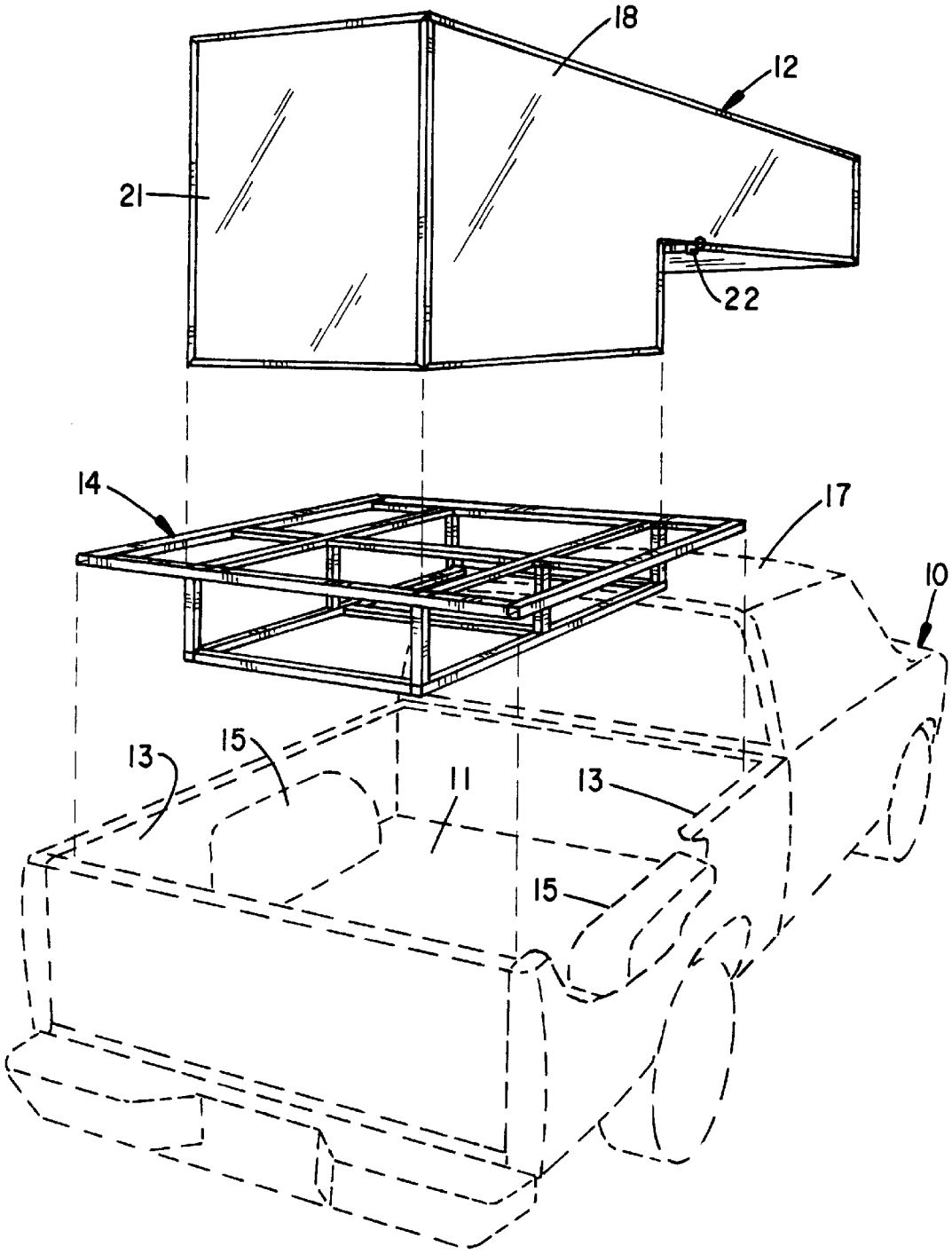
FIG. 6 is an exploded view illustrating how the advertising display and bed frame member fit into the bed of a pickup truck.

The aforementioned design allows the bed frame member 14 to be easily placed in the bed 11 of the truck 10. The bottom of the bed frame member 14 fits snugly between the wheel wells 15 of the bed 11 of the pickup truck 10 and the top of the bed frame member 14 fits over the wheel wells 15 and snugly against the sidewalls 13 of the bed 11 of the pickup truck 10 as illustrated in FIG. 6. The snug fit of the bed frame member 14 provides stability to the advertising display 12 as the truck maneuvers down a road. The bed frame member 14 may be made of steel but any other material that is strong enough to hold up the advertising display and heavy enough to weigh down the advertising display 12 when the pickup truck 10 is moving may be substituted.

Figure 5:
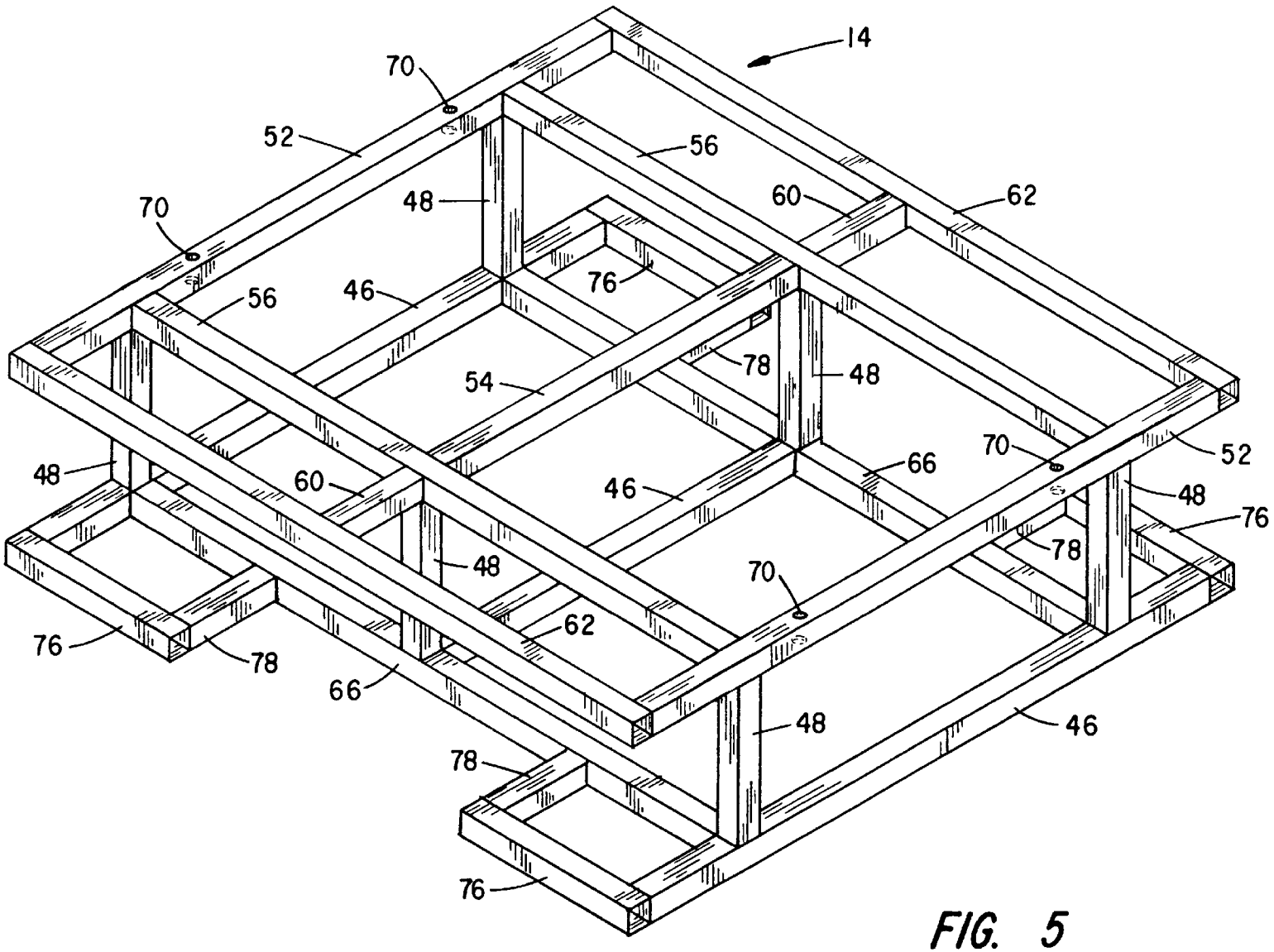
FIG. 5 is a perspective view of the second embodiment of the bed frame member.

My second embodiment of the bed frame member 14 is illustrated in FIG. 5. It is the same as the first embodiment except that the lower outer horizontal frame members 46 are lengthened and elements for support are added. In this embodiment, bottom extending frame support members 78 are solidly connected to the bottom side frame members 66. Outside frame support members 76 are then solidly connected to the other end of the bottom frame support members 78 and to the lower horizontal frame members 46. In this embodiment the bottom portion of the bed frame member 14 is designed to fit around the wheel wells 15 of the bed 11 of the pickup truck 10 for added stability.

As with both embodiments of the bed frame member 14 the advertising display is connected to the bed frame member 14 in the same manner. As illustrated in FIG. 2, the bottom of the advertising display 12 has a plurality of display mounting holes 26 in the bar support members 24. These display mounting holes 26 go all the way through the bottom panel 23. In addition, the top of the bed frame member 14 has a plurality of frame mounting holes 70 as illustrated in FIG. 4 and 5. When the advertising display 12 is properly positioned on top of the bed frame member 14, as illustrated in FIG. 6, the display mounting holes 26 line up with the frame mounting holes 70. Bolts may then be inserted through the display mounting holes 26 and the frame mounting holes 70 to solidly connect the advertising display 12 to the bed frame member 14.

Once the bed frame member 14 and the advertising display 12 are placed in the back of the pickup truck 10, the advertising display 12 may be secured to the pickup truck 10. A plurality of secure hooks 22 are solidly connected to the advertising display 12 in which a rope or cable 80 can attach the advertising display 12 to the bed 11 of the pickup truck 10. The secure hooks are illustrated in FIG. 2 and 6. Securing the advertising display 12 in this manner provides extra stabilization when the truck accelerates, decelerates or makes a turn.

I have designed an advertising display 12 in combination with a pickup truck 10 that overcomes the limitations of the prior art. My design provides a large area to advertise with and can be quickly and easily moved from one pickup truck 10 to another. Moreover, my advertising display 12 and the bed frame member 14 can be sized to fit pickup trucks with standard cabs, extended cabs, trucks with long beds or trucks with short beds. Although, alternative embodiments and modifications are contemplated, I have disclosed my preferred embodiments. In addition, changes and alterations may be made to my preferred embodiments without departing from the spirt of and scope of my invention, as defined by the following claims.

What is claimed is:

1. An advertising display in combination with a pickup truck comprising:

the pickup truck having a bed of a given width and length, the bed having a floor, a pair of wheel wells and a pair of sidewalls of equal height; and a bed frame member having a height substantially equal to the height of the sidewalls of the bed of the pickup truck, having a length slightly shorter than the length of the bed of the pickup truck and having a bottom end and a top end, the bottom end having a width slightly less than the distance between the wheel wells of the bed of the pickup truck and resting on the floor of the bed of the pickup truck; and an advertising display of a given height and width, the advertising display being removably connected to the top end of the bed frame member; and a plurality of translucent advertising panels for displaying advertising messages being removably connected to the advertising display; and a plurality of light sources encased inside the advertising display for illumination of the advertising panels.

2. An advertising display in combination with a pickup truck as disclosed in claim 1 wherein the advertising display has a portion that extends over the cab of a pickup truck.

3. An advertising display in combination with a pickup truck as disclosed in claim 1 wherein the top end of the bed frame member has a width slightly less than the distance between the sidewalls of the bed of the pickup truck.

4. An advertising display in combination with a pickup truck as disclosed in claim 1 wherein the bottom end of the bed frame member has a portion that fits around the wheel wells of the bed of the pickup truck.

5. An advertising display in combination with a pickup truck as disclosed in claim 1 further comprising:

a plurality stabilizing hooks solidly attached to the advertising display; and a means for connecting the stabilizing hooks to the pickup truck.

* * * * *